US006176069B1

(12) United States Patent
Kössendrup

(10) Patent No.: US 6,176,069 B1
(45) Date of Patent: Jan. 23, 2001

(54) METHOD FOR THE PRODUCTION OF A COMPOSITE CARTON CONTAINER AND COMPOSITE CARTON CONTAINER PRODUCED ACCORDING TO THE METHOD

(75) Inventor: Klaus Kössendrup, Schifferstadt (DE)

(73) Assignee: Weidenhammer Packungen KG GmbH & Co., Hockenheim (DE)

( * ) Notice: Under 35 U.S.C. 154(b), the term of this patent shall be extended for 0 days.

(21) Appl. No.: 09/113,159

(22) Filed: Jul. 10, 1998

(30) Foreign Application Priority Data

Jul. 17, 1997 (DE) ..... 297 12 611 U

(51) Int. Cl.[7] ..... B65B 7/28

(52) U.S. Cl. ..... 53/471; 53/478; 53/486; 493/108; 493/158

(58) Field of Search ..... 53/471, 478, 485, 53/486, 242, 243, 289; 493/102, 104, 108, 158, 159

(56) References Cited

U.S. PATENT DOCUMENTS 2,248,534 * 7/1941 Meyer-Jagenberg ..... 493/102
5,827,161 * 10/1998 Petit ..... 493/102

FOREIGN PATENT DOCUMENTS 1 004 344 11/1992 (BE) .
0 753 398 1/1997 (EP) .

* cited by examiner

*Primary Examiner*—Linda Johnson
(74) *Attorney, Agent, or Firm*—Paul Vincent

(57) ABSTRACT

A container having a casing made from composite carton and constituting a container body, which is covered on its inside by a barrier layer and a plastic layer deposited thereon, is produced in such a fashion that the casing is rolled over in an outward direction at one end to form a curled edge and, subsequently, a membrane is sealed onto the upper crown of the curled edge. A bottom is attached to the opposite end after the container is filled. In order to guarantee a sealed closure, the casing is tapered inwardly in a conical manner at its one end along a length which is larger than the circumference of the curled edge in such a manner that the outer diameter in the vicinity of the tapered end is smaller by approximately twice the diameter of the curled edge than the outer diameter of the casing. The end is then rolled over in an outer direction to form a curled edge and is then sealed by the membrane.

2 Claims, 2 Drawing Sheets

METHOD FOR THE PRODUCTION OF A COMPOSITE CARTON CONTAINER AND COMPOSITE CARTON CONTAINER PRODUCED ACCORDING TO THE METHOD

This application claims Paris Convention priority of German Utility Model application number 297 12 611.3 filed Jul. 17, 1997 the complete disclosure of which is hereby incorporated by reference.

BACKGROUND OF THE INVENTION

The invention concerns a method for the production of a container having a casing constituting the container body made from composite carton whose inner side is covered by a barrier layer and a plastic layer deposited thereon, in which one end of the casing is rolled-over in an outward direction to form a curled edge and a membrane is subsequently sealed to the upper crown of the curled edge. A bottom is attached at its opposite end after the container is filled.

Composite carton containers of the above mentioned kind are often used for the packaging of pourable, in particular powder-like or granular materials or also for fluid products having a viscous or pasty consistency. In order to protect the quality of the fill product the composite carton container must be sealed, wherein, in dependence on the fill product, liquid tight or even gas-tight sealing is required. The casings are generally produced through winding of an endless length of material or from a material blank cut to the appropriate length for the casing. In the former case, the casing is cut to the desired size from the produced wound tube by means of a cutting process. Sealing of the casing is guaranteed by a barrier layer e. g. a metal, in particular, an aluminum foil layer, laminated onto the normally multi-layered base of recycling carton material and then covered by a thin plastic layer. Overlapping edges of the length of material or of the material blank are sealed along the winding seam.

The casing is rolled over in an outward direction at the end subsequently forming the removal opening to form a curled edge for maintaining the open cut edge of the casing and for protecting it against the entrance of liquids as well as to facilitate sealing of a membrane onto the outer plastic coating of the curled edge, the sealing membrane having a corresponding plastic coating on its inside. In this manner, a gas and liquid tight first-opening seal is also fashioned in the region of the removal opening. However, in practice, leaks often occur near the sealed membrane, whereas the bottom, which is introduced onto the opposite end subsequent to filling, is easily rendered leak proof.

With sheet metal containers having fundamentally similar construction (EP 0806 370), the sheet metal blank is dipped into liquid plastic after rolling the curled edge. This plastic then hardens to an enlargement on the curled edge having a thickness which is difficult to control. The membrane is sealed onto this relatively thick plastic layer. This procedure requires a separate dipping step which is an additional production step and is also time consuming, since one must wait until the plastic layer has polymerized. When the sealing membrane is removed, residual plastic irregularities remain on the edge and loosened plastic particles can fall into the filled product which is not tolerable for food products.

With composite carton containers, the unexpected leakage in the vicinity of the sealed membrane is probably due to the fact that, when rolling over the curled edge in an outward direction, the plastic laminate is thinned or even torn due to material stretching. Cracks in the barrier layer can also occur.

It is therefore the underlying purpose of the invention to further improve the above mentioned method for the production of composite carton container in such a manner that the gas and liquid sealing in the vicinity of the sealed membrane is as good as the sealing over the entire remaining regions of the casing.

SUMMARY OF THE INVENTION

This purpose is achieved in accordance with the invention in that the casing, at one of its ends, is tapered conically in an inward direction along a length which is larger then the circumference of the curled edge in such a manner that the outer diameter in the vicinity of the tapered-in end edge is smaller by approximately twice the diameter of the curled edge than the outer diameter of the casing and, subsequently, the end is rolled over in an outward direction into a curled edge onto which the membrane is sealed.

The conical tapering of the casing in the vicinity of its one end forming the removal opening in the final state causes a reduction in diameter so that the composite container material, including the inside laminate comprising the barrier layer and the plastic coating, has a compressed girth. Tiny folds are evenly distributed about the girth. When the compressed end is subsequently rolled over in the outward direction to generate the curled edge, the material can be pulled out of the folds so that, in particular, a tearing of the metal foil or of the plastic laminate in the vicinity of the edge and in particular in proximity to the removal opening is effectively avoided. A closed plastic laminate remains near the upper crown of the curled edge which allows the sealing membrane to be reliably sealed in its edge region onto the curled edge to effect a closed sealing seam around the entire periphery. Faulty locations in the sealing seam do not occur and undesirable clumps of plastic are not present. The composite carton container produced in this manner is also gas and liquid tight in the region of the sealing membrane.

In a preferred embodiment, the casing is tapered inwardly along a length corresponding to approximately twice the circumference of the curled edge.

This measure solves the purpose in accordance with the invention in a particularly advantageous fashion. Furthermore, the tapering of the inlet on the casing end can be chosen in such a fashion that the curled edge is approximately aligned with the outer contour of the casing and does not protrude beyond same. This is advantageous for transport and storage of casings sealed with the sealing membrane. In addition, the conical taper is relatively steep so that the gathered-in edge of the casing does not hinder pouring of the fill product when the container is emptied.

A composite carton container produced by the method in accordance with the invention has the distinguishing characteristic that the casing at the curled edge has an outer diameter which approximately corresponds to the outer diameter of the casing in the non-shaped region, so that no regions are present which project beyond the casing, which could hinder the transport and handling of casings not yet equipped with the bottom during production or filling. The containers can roll in a linear direction in close proximity to each other both in the peripheral as well as in the axial direction without mutual hindrance.

As is per se known in the art, a slip lid serves for reclosure after the sealing membrane has been torn open having a ring shaped bead at the inner side of its edge engaging the curled edge which snaps beneath the curled edge.

The invention is described below with reference to the embodiment represented in the drawing.

DESCRIPTION OF THE PREFERRED EMBODIMENT

Figure 1:
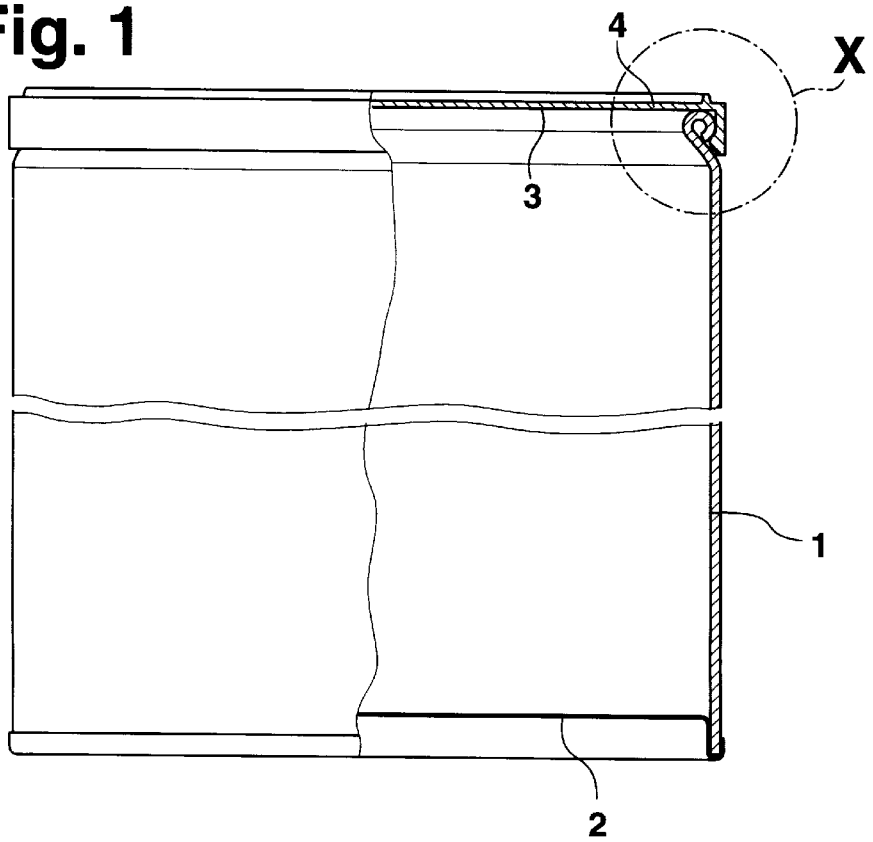
FIG. 1 shows a composite carton container having a slip lid, partially in side and partially in axially cut views.

The closed container partially shown in cut view in FIG. 1 consists essentially of a casing I produced by a multi-layer wound carton, a floor 2, a membrane 3 closing the removal openings and a lid 4 which slips over the removal opening.

Figure 2:
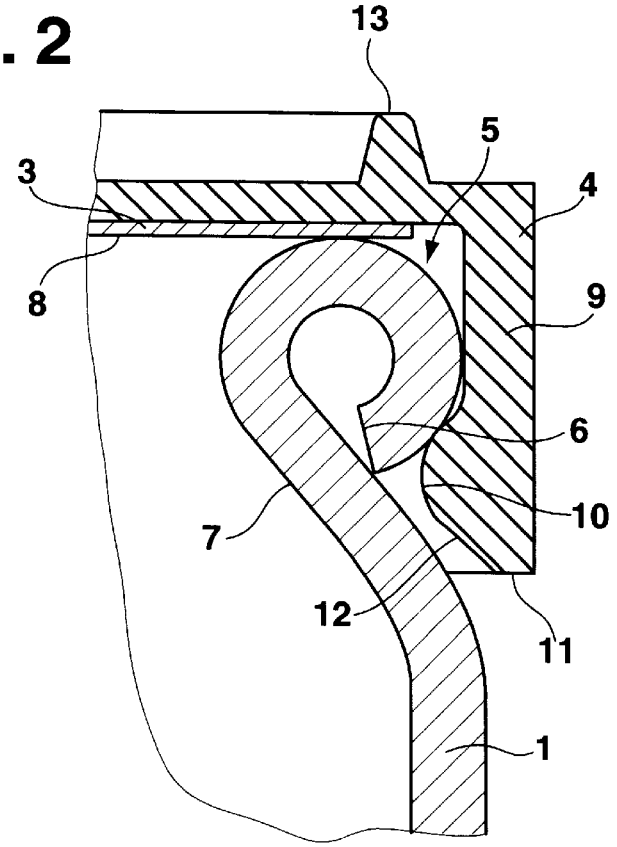
FIG. 2 shows the detailed section "X" of FIG. 1 in an enlarged scale.

The enlarged detail representation of FIG. 2 shows the edge of the casing rolled-over into a curled edge 5 shaped in a substantially circular fashion so that the open cut edge 6 is located in a protected inner region of the curled edge 5.

The casing 1 has a laminate 7 on its inner side made from a barrier layer, e.g. metal foil, and an inwardly disposed plastic layer fashioned by a foil or a coating. The laminate is consequently disposed on the outer side of the curled edge 5.

A flat sealing membrane 3, e. g. a plate made from cardboard, paper or metallic foil, is sealed onto the curled edge and has a corresponding plastic laminate on its inner side. The membrane 3 forms a fluid-tight first-opening seal.

The casing 1 is gathered inwardly in the vicinity of the removal opening so that the outside of the curled edge 5 is approximately aligned with the outer envelope of the casing 1. The slip lid 4 which engages over the curled edge 5 is approximately aligned with the outer side of the bottom 2.

The slip lid 4 has a ring bead 10 on the inside of its wall 9 with which it snaps over the curled edge 5. The inner side of the wall 9 slants outwardly from the ring bead 10 to the lower edge 11 in such a manner that the slant 12 is approximately parallel to the taper of the casing.

Finally, the lid 4 has a ring shaped rib 13 on its upper side serving as a stacking edge to allow a plurality of layers of filled containers to be disposed above each other in a secure fashion, e.g. for disposal on a transport pallet.

The membrane 3 can also be connected to the slip lid 4 so that the initial opening of the slip lid 4 leads to simultaneous removal of the membrane.

Figure 3:
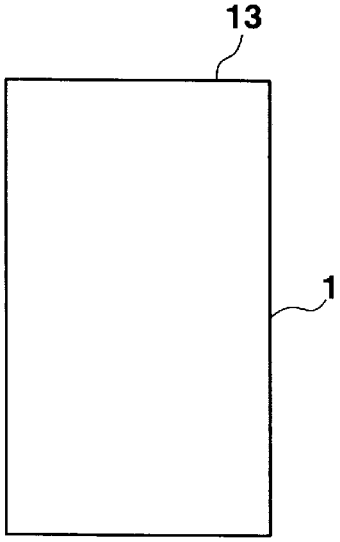
FIG. 3 shows a first production stage of the composite carton casing in schematic view.
Figure 4:
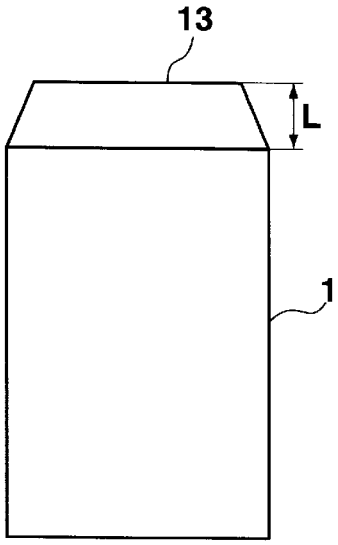
FIG. 4 shows a second production stage of the composite carton casing in schematic view.
Figure 5:
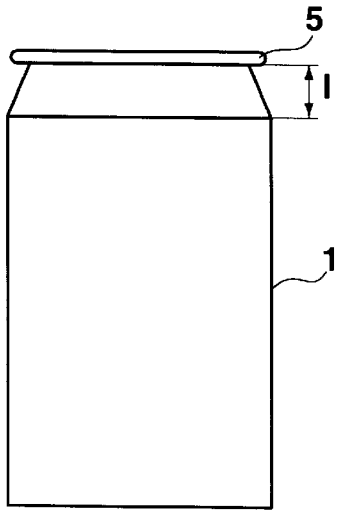
FIG. 5 shows a third production stage of the composite carton casing in schematic view.

The casing 1 is shown in FIGS. 3–5 in differing stages of manufacture. FIG. 3 shows the unformed casing 1 cut to length from a wound tube to the desired size. The casing 1 is tapered conically inwardly along a length L (FIG. 4) in a first forming step at that end 13 subsequently constituting the removal opening. In an additional forming step, the casing 1 is rolled over at its end 13 in an outer direction to form the curled edge 5S wherein a conical section of length 1 remains (FIG. 5). The length L is approximately twice the circumference of the curled edge 5 so that the remaining conical length 1 corresponds approximately to the circumference of the curled edge 5.

Figure 6:
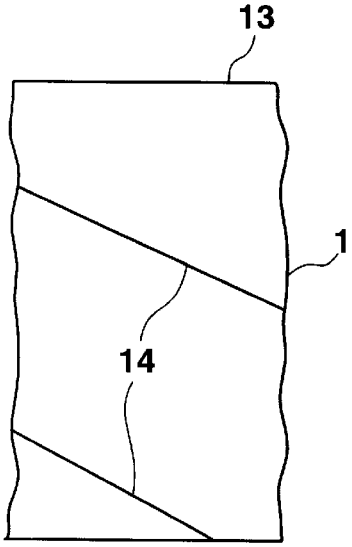
FIG. 6 shows an unfolded inner view of the casing in the production stage corresponding to FIG. 3.

FIG. 6 shows an unfolded view of the inside of the casing 1. The overlap lines 14 formed by the helical winding of an endless length of material can be seen between the adjacent composite carton lengths. The swaths are sealed to each other along these overlaps in a fluid-tight manner.

Figure 7:
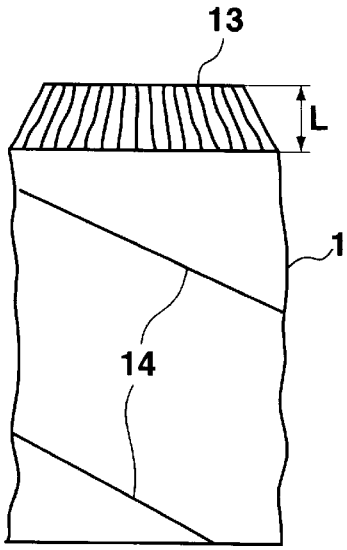
FIG. 7 shows an unfolded inner view of the casing in the production stage corresponding to FIG. 4.
Figure 8:
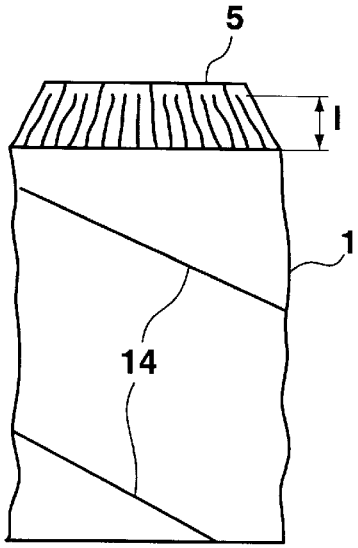
FIG. 8 shows an unfolded inner view of the casing in the production stage corresponding to FIG. 5.

FIG. 6 shows the casing in the non-formed state according to FIG. 3. The conical shaping of the casing 1 in the vicinity of the one end 13 leads to the formation of folds on the inner side of the casing 1 which taper towards the end edge in correspondence with the conical taper (FIG. 7). These folds, which are also followed by the inner laminate having the barrier layer and the plastic coating, provide a reserve amount of material for the subsequent formation of the curled edge 5 (FIG. 8). Since the casing 1 is thereby widened again near its end 13, the material and laminate can be pulled out of the folds during curling so that the laminate does not tear to, in particular, assure a continuous plastic laminate on the upper crown of the curled edge 5 (FIG. 2) to which the membrane 3 laminate is sealed in a leak-proof manner.

I claim:

1. A method for producing a container having a tubular casing constituting a container body and made from composite carton material covered at an inner side with a barrier layer and a plastic coating deposited over the barrier layer, the tubular casing having a diameter, a first end, and a second opposite end, the method comprising the steps of:

a) inwardly tapering the tubular casing toward the first end along a tapered length, said first end thereby acquiring a first end diameter which is reduced compared to untapered portions of the tubular casing;

b) rolling over, following steg a), said first end in an outward direction to form a curled edge having an upper crown, said curled edge having a diameter and a circumference, wherein said tapered length is larger than said curled edge and said first end diameter is smaller, by approximately twice said curled edge diameter, than the tubular casing diameter in untapered portions of the tubular casing;

c) tightening the container with a membrane by sealing said membrane onto said upper crown of said curled edge;

d) filling the container; and e) attaching a bottom to the container body at the second end of the tubular casing.

2. The method of claim 1, wherein said tapered length is approximately twice said circumference of said curled edge.

* * * * *